US007928847B2

(12) United States Patent
Murdoch et al.

(10) Patent No.: US 7,928,847 B2
(45) Date of Patent: Apr. 19, 2011

(54) ANTENNA DESIGN AND INTERROGATOR SYSTEM

(75) Inventors: Graham Alexander Munro Murdoch, Woolstonecraft (AU); Stuart Colin Littlechild, Habefield (AU)

(73) Assignee: Magellan Technology Pty Limited, Annandale, New South Wales (AU)

( * ) Notice: Subject to any disclaimer, the term of this patent is extended or adjusted under 35 U.S.C. 154(b) by 254 days.

(21) Appl. No.: 12/066,287

(22) PCT Filed: Sep. 8, 2006

(86) PCT No.: PCT/AU2006/001318
§ 371 (c)(1),
(2), (4) Date: Jun. 10, 2008

(87) PCT Pub. No.: WO2007/030861
PCT Pub. Date: Mar. 22, 2007

(65) Prior Publication Data

US 2008/0252423 A1 Oct. 16, 2008

(30) Foreign Application Priority Data

Sep. 12, 2005 (AU) ..... 2005905027

(51) Int. Cl.
*G08B 13/14* (2006.01)

(52) U.S. Cl. ..... 340/572.7; 340/572.1

(58) Field of Classification Search ..... 340/572.7, 340/572.1; 343/842, 867
See application file for complete search history.

(56) References Cited

U.S. PATENT DOCUMENTS

| | | | | |
|---|---|---|---|---|
| 4,633,250 | A * | 12/1986 | Anderson, III et al. | 340/572.7 |
| 5,258,766 | A | 11/1993 | Murdoch | |
| 5,302,954 | A | 4/1994 | Brooks et al. | |
| 5,940,003 | A | 8/1999 | Schulz | |
| 6,005,638 | A | 12/1999 | Blair et al. | |
| 6,034,603 | A | 3/2000 | Steeves | |
| 6,060,988 | A * | 5/2000 | Copeland et al. | 340/572.1 |
| 6,061,475 | A | 5/2000 | Blair | |
| 6,294,953 | B1 | 9/2001 | Steeves | |
| 6,570,487 | B1 | 5/2003 | Steeves | |
| 6,720,930 | B2 * | 4/2004 | Johnson et al. | 340/572.7 |
| 6,954,859 | B1 | 10/2005 | Simerly et al. | |
| 6,970,141 | B2 * | 11/2005 | Copeland et al. | 340/572.7 |
| 7,005,985 | B1 | 2/2006 | Steeves | |

(Continued)

FOREIGN PATENT DOCUMENTS

WO WO-96/002954 2/1996

(Continued)

OTHER PUBLICATIONS

Sulcs, Evan, International Search Report; Oct. 17, 2006, (4 pages).

*Primary Examiner* — John A Tweel, Jr.
(74) *Attorney, Agent, or Firm* — Winstead PC

(57) ABSTRACT

A series of parallel spaced conductors through which currents are sequentially switched. A spatial relationship of the sequentially switched currents is chosen such that, at different times, tangential and normal magnetic fields are produced at the same location. The conductors are preferably arranged in a planar fashion and the tangential and normal magnetic fields are produced above the planar surface. A single layer of parallel spaced conductors provides substantially two dimensional operations. Adding a second parallel layer of orthogonally oriented parallel spaced conductors provides substantially three dimensional operations where currents are sequentially switched in both layers.

60 Claims, 19 Drawing Sheets

U.S. PATENT DOCUMENTS

| | | | | |
|---|---|---|---|---|
| 7,199,717 | B2 * | 4/2007 | Lian et al. | 340/572.7 |
| 7,271,727 | B2 | 9/2007 | Steeves | |
| 7,286,158 | B1 | 10/2007 | Griebenow | |
| 7,439,862 | B2 * | 10/2008 | Quan | 340/572.7 |
| 7,696,876 | B2 * | 4/2010 | Dimmer et al. | 340/572.1 |
| 2005/0162276 | A1 * | 7/2005 | Balch et al. | 340/572.7 |
| 2006/0066444 | A1 | 3/2006 | Steeves | |
| 2006/0071756 | A1 | 4/2006 | Steeves | |
| 2007/0008140 | A1 * | 1/2007 | Saarisalo et al. | 340/572.7 |
| 2007/0159338 | A1 | 7/2007 | Beber et al. | |
| 2007/0205896 | A1 | 9/2007 | Beber et al. | |
| 2007/0285241 | A1 | 12/2007 | Griebenow et al. | |
| 2008/0042850 | A1 | 2/2008 | De Witte et al. | |

FOREIGN PATENT DOCUMENTS

| | | |
|---|---|---|
| WO | WO-96/041399 | 12/1996 |
| WO | WO-99/34526 | 7/1999 |
| WO | WO-00/28614 | 5/2000 |
| WO | WO-02/052590 | 7/2002 |
| WO | WO-2004/019055 | 3/2004 |
| WO | WO-2005/069440 | 7/2005 |

* cited by examiner

ANTENNA DESIGN AND INTERROGATOR SYSTEM

FIELD OF INVENTION

The present invention relates to the field of radio frequency identification (RFID).

In one form, the invention relates to an interrogator antenna for interrogating a remote device, such as an RFID transponder.

The invention has been developed primarily for interrogating multiple passive transponders which are attached to objects to be identified by those respective transponders and will be described hereinafter with reference to that application. A typical application is the identification of RFID transponders or other RFID devices, such as those embedded in plastic tokens or cards that are stacked on each other.

The present invention also relates to an antenna design.

In one form, the invention relates to a particular layout of antenna coils. In another form, the invention relates to an interrogator including an arrangement of antenna coils.

The present invention has many applications, including any application where antennas are used to radiate fields, especially for the purpose of interrogation of a remote device. In a particular application, the present invention may be used in conjunction with RFID devices, such as, by way of example only, RF transponders, tags, tokens, labels, etc. Such devices may be used in a wide variety of applications, including, without limitation, article tracking such as shelving and storage systems, document management or article identification and/or sorting, gaming apparatus and gaming tokens, and luggage identification.

It will be convenient to hereinafter describe the invention in relation to interrogating RFID devices, however it should be appreciated that the present invention is not limited to that use only.

BACKGROUND ART

The discussion throughout this specification comes about due to the realisation of the inventors and/or the identification of certain prior art problems by the inventors.

The applicants are aware of a number of transponder systems that provide two dimensional, limited three dimensional or full three dimensional capability. These systems utilise a multiplicity of interrogator coils operating in different coordinate axis, to achieve two or three dimensional operation.

One particular interrogator design produces a uniform field in three dimensions. This form of interrogator is known as a Tunnel Reader Programmer (TRP). An example of a TRP for interrogating transponders on pallets or conveyors which meets all OH&S and EM regulations in Australia is disclosed in U.S. Pat. No. 5,258,766 and international application PCT/AU95/00436.

While a TRP has three dimensional interrogation properties, it is suitable for applications where the RFID transponders are moved in and out of the TRP, usually on a conveyor or similar. TRP are inherently unsuitable for applications requiring the interrogator to operate on a flat surface such as a table or wall. For these applications flat planar antenna coils are required however these coils suffer from producing fields in only one direction at any point relative to the coil and do not have a three dimensional interrogation capability.

FIG. 1 illustrates a conventional planar antenna coil arrangement, in which the coil 10 has windings 11 arranged in a somewhat circular configuration.

FIG. 2 illustrates a cross sectional view X of FIG. 1 of the windings of the coil of FIG. 1. The magnetic field created by inducing power into the windings is represented 12. If a transponder 13 has a coil (not shown), but placed on it's outer top surface, for example, and if the transponder 13 is positioned substantially horizontally between the windings as illustrated in FIG. 2, the field 12 produced by the windings 11 has a correct orientation to power to transponder. Equally, if a transponder 14 is placed in a substantially vertical orientation as illustrated in FIG. 2, it too will be powered by the field 12. However, if a transponder 15 is placed substantially horizontally near or outside the windings 11, the field 12 generated by the windings will not be correctly oriented to power the transponder 15. Likewise if the transponder is placed in a substantially vertical orientation in the inside of the windings 11 and 12 as illustrated in 16, the field 12 generated by the windings will not be correctly oriented to power the transponder 15.

If RFID and remote powering is used in applications where orientation of the items to be identified cannot be guaranteed, such as shelving and storage systems, document tracking, luggage identification, gaming tokens, by way of example only, the above identified problem can lead to items being missed, that is, not correctly identified.

Any discussion of documents, devices, acts or knowledge in this specification is included to explain the context of the invention. It should not be taken as an admission that any of the material forms a part of the prior art base or the common general knowledge in the relevant art in Australia or elsewhere on or before the priority date of the disclosure and claims herein.

An object of the present invention is to provide an antenna design and/or interrogator which is more likely to enable powering and/or communication with an RFID device.

A further object of the present invention is to alleviate at least one disadvantage associated with the prior art.

SUMMARY OF INVENTION

In one form, the invention relates to an identification system, and devices used in the system. Examples of the devices include transponders and/or apparatus adapted to be incorporated into items for storage on shelving and/or in storage systems. Another example of the devices includes transponders and/or apparatus adapted to be incorporated into articles in a secure site, such as legal evidence samples which employ the use of a transponder and/or other identification device attached to the sample(s) for the purposes of monitoring and/or recording movements of the samples. Still another example of the devices includes tokens and/or apparatus adapted to be incorporated into gaming tables and/or devices.

In another form, the invention relates to a system for monitoring and/or recording gaming transactions in a casino, such as gaming transactions which employ the use of a gaming token which token has a transponder and/or other identification device therein.

Preferably, a method of reading is substantially in accordance with PCT/AU2003/001072, the disclosure of which is incorporated herein by reference.

Preferably, a method of reading is substantially in accordance with U.S. Pat. No. 5,302,954, the disclosure of which is incorporated herein by reference.

Preferably, a method of powering, interrogating and/or communicating with an RFID device is substantially in accordance with WO9934526, the disclosure of which is incorporated herein by reference.

The present invention provides, in one aspect of invention, an arrangement and/or method of arranging coils, comprising a first coil having first at least two first windings, a second coil having at least a second windings, the second winding being juxtaposed intermediate the first windings.

The present invention provides, in another aspect of invention, a method of and/or apparatus for energising a first arrangement of coils and a second arrangement of coils, the first coils having at least two first windings and the second coil having at least a second winding, the second winding being juxtaposed intermediate the first windings, the method comprising the steps of energising the first coil, energising the second coil, wherein the first and the second coil are alternately switched.

Other aspects and preferred aspects are disclosed in the specification and/or defined in the appended claims, forming a part of the description of the invention.

In essence, the present invention provides for a series of parallel spaced conductors through which currents are sequentially switched. In one form, tangential and normal magnetic field components are produced. The spatial relationship of the sequentially switched currents is chosen such that, at different times, a tangential and a normal magnetic field are produced at the same location. The conductors are preferably arranged in a planar fashion and the tangential and normal magnetic fields are produced above the planar surface. A single layer of parallel spaced conductors provides substantially two dimensional operations. Adding a second parallel layer of orthogonally oriented parallel spaced conductors provides substantially three dimensional operations where currents are sequentially switched in both layers.

The present invention has been found to result in a number of advantages, such as:

- Provides a simple planar antenna design which produces strong interrogation fields in two or three dimensions
- The antenna is ideally suited for table mounting or mounting to or as a flat surface onto which transponders may be placed to be interrogated.
- Depending upon the antenna design transponders can be interrogated regardless of their orientation in two or three dimensions.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further disclosure, objects, advantages and aspects of the present application may be better understood by those skilled in the relevant art by reference to the following description of preferred embodiments taken in conjunction with the accompanying drawings, which are given by way of illustration only, and thus are not limitative of the present invention, and in which.

DETAILED DESCRIPTION

Figure 3:
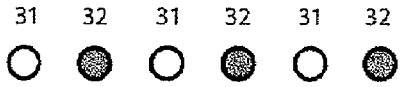
FIG. 3 illustrates one aspect of invention, namely the interleaving of coil windings.

FIG. 3 illustrates one aspect of invention, namely the interleaving of coil windings. FIG. 3 illustrates, by way of example only and in cross section, 2 sets of windings, namely winding 31 and winding 32 where the winding are individually interleaved.

Figure 1:
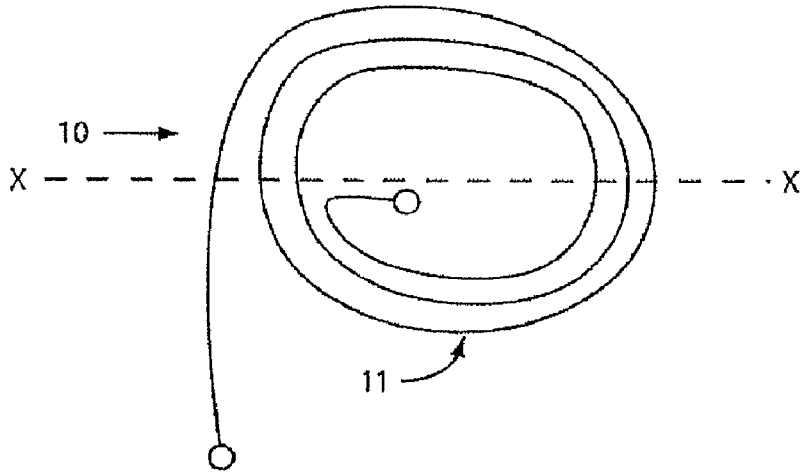
Figure 1 (PRIOR ART)
FIG. 1 illustrates a prior art antenna coil arrangement.
Figure 2:
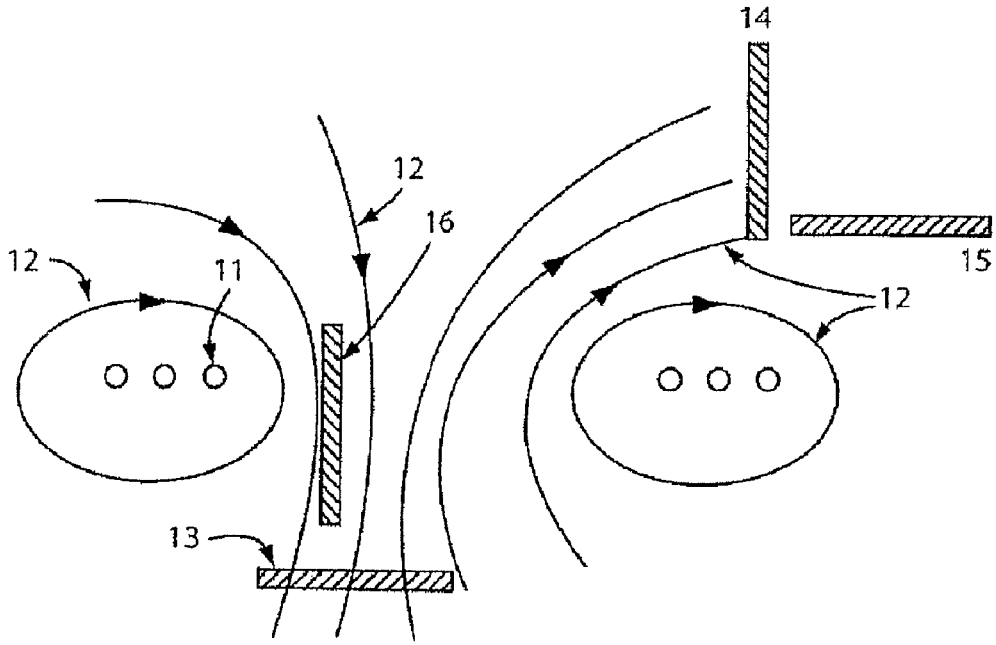
FIG. 2 illustrates magnetic fields associated with the coil of FIG. 1 as well as a number of token orientations.
Figure 4:
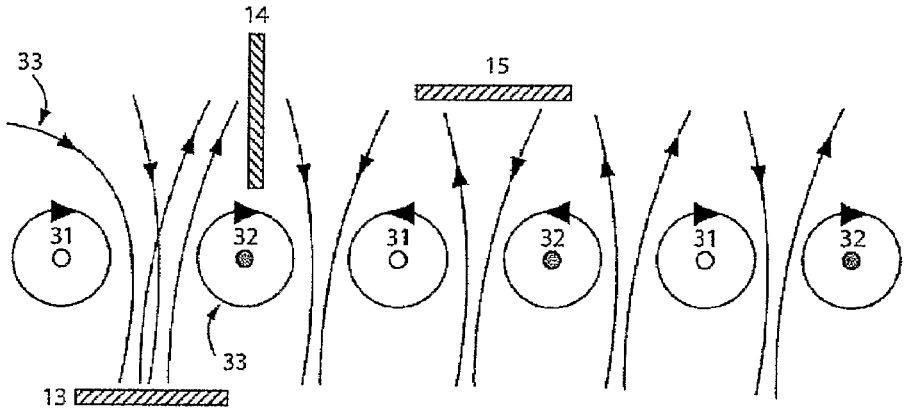
FIG. 4 illustrates a portion (only) of the magnetic fields 33 associated with the winding arrangement of FIG. 3, FIGS. 5*a* and 5*b* illustrate another aspect of invention, namely alternate switching of coil windings.

FIG. 4 illustrates a portion (only) of the magnetic fields 33 associated with the winding arrangement of FIG. 3. If the transponders 13, 14 and 15 as shown in FIG. 2 are placed in substantially the same position as that shown in FIG. 2, it can be seen that in the arrangement of this aspect, the transponders are able to be powered and/or communicated with. The reason for this, is that the windings, in this aspect, are relatively closely spaced and in a manner which creates magnetic fields (of various intensity) substantially over the length over which the transponders is to be moved. Thus, for example, as transponders 15 is moved from left to right (of FIG. 4) the transponders is powered and/or communicated by one winding, then another, then another.

Figure 5A:
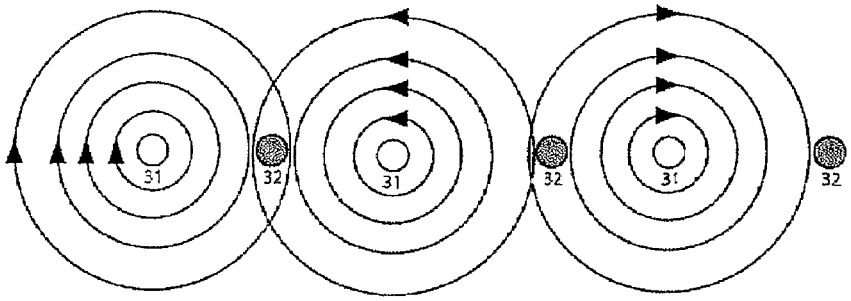
Figure 5B:
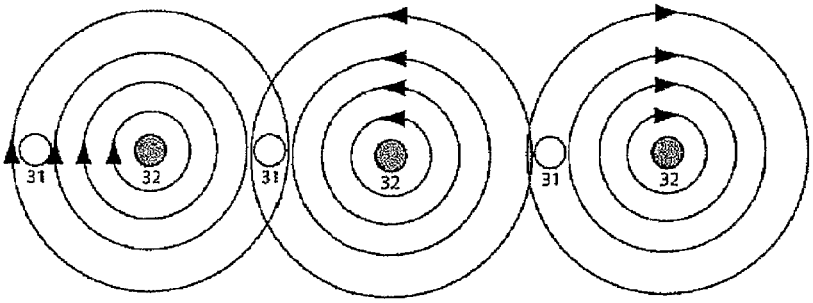

In another aspect of invention, the windings 31 and 32 are alternately switched. That is, winding 31 is powered, while winding 32 is not powered. Subsequently, winding 32 is powered, while winding 31 is not powered, and so on. The effect of this switching is illustrated in FIGS. 5*a* and 5*b* FIG. 5*a* illustrates the field created by activating windings 31. It can be seen that the field radiates proximate the region occupied by winding 32 (not powered). Thus if a token moves from past windings 31 or 32, it will be powered and/or communicated with by the fields created by winding 31. Likewise, FIG. 5*b*illustrates the field created by activating windings 32. It can be seen that the field radiates proximate the region occupied by winding 31 (not powered). Thus if a transponders moves from past windings 32 or 31, it will be powered and/or communicated with by the fields created by winding 32. When the 'alternate switching' feature of this aspect of invention of FIGS. 5*a* and 5*b* are combined with the 'winding arrangement' feature of an aspect of invention, it can be seen that when applied to FIG. 4 how it is possible that the transponders 13, 14 or 15 can be powered and/or communicated.

Figure 6:
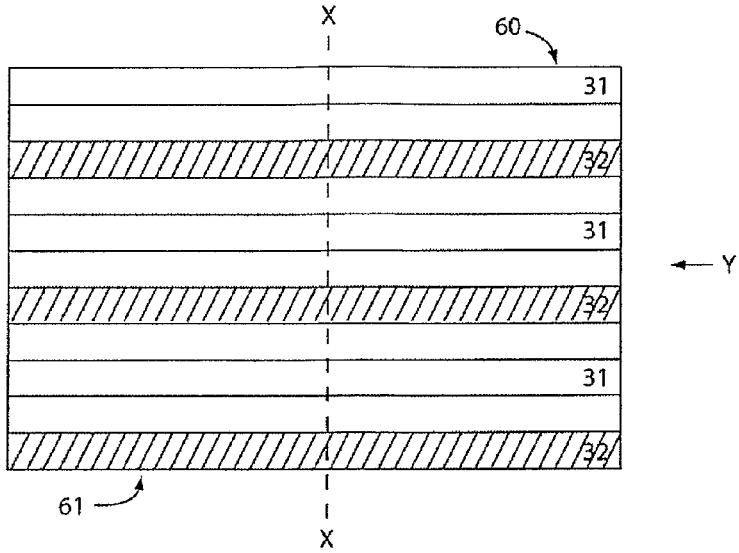
FIG. 6 illustrates an antenna module in accordance with a further aspect of invention.

In another aspect of invention, the windings of a coil can be arranged in a manner as illustrated in FIG. 6. The arranged results in a antenna 'module' 60. In this aspect, there is a base 61 upon which windings 31 and 32 are formed. The windings 31 and 32 are suitably interconnected, but the connections are not shown as any suitable manner of coupling to a source of power and/or communications can be implemented. If a section X is taken of FIG. 6, the arrangement of FIG. 3 is seen. Thus when the antenna module 60 is suitably energised, the operation results in that described with reference to FIGS. 4, 5*a* and 5*b*.

Figure 7:
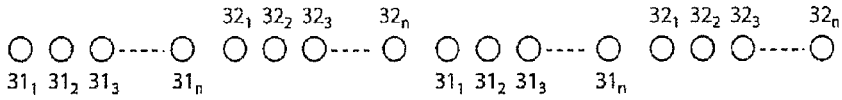
FIG. 7 illustrates, in cross section, a further embodiment of coil windings

Taking the principle of the interleaving of coil windings of FIG. 3, FIG. 7 illustrates, in cross section, a further embodiment, in which there are sets of 1-n coil windings 311, 312, 313, . . . 31*n* which are interleaved with coil windings 321, 322, 323, . . . 32*n*.

Applying the coil switching as disclosed with reference to FIGS. 5*a* and 5*b*, but applying it to the winding arrangement of FIG. 7, results in the powering of and/or communication with coil windings 311, 312, 313, . . . 31*n* whilst coil windings 321, 322, 323, . . . 32*n* are inactive, and subsequently, the powering of and/or communication with coil windings 321, 322, 323, . . . 32*n* whilst coil windings 311, 312, 313, . . . 31*n* are inactive. Clearly it is contemplated that the antenna module of FIG. 6 may comprise a coil arrangement having any number of windings (1-n) and, for example as shown in FIG. 7.

A particular application of the present invention is the identification of trays containing RFID devices (such as tags attached to articles to be identified and/or gaming tokens that are stacked vertically or stacked horizontally in trays or are randomly placed).

Figure 8:
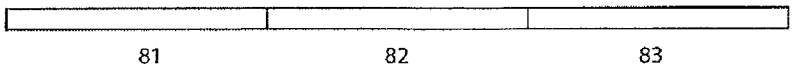
FIG. 8 illustrates an arrangement of antenna modules.
Figure 9:
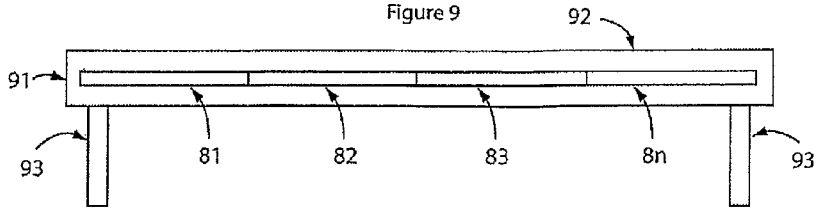
FIG. 9 illustrates an arrangement of antenna modules incorporated into a gaming table.

FIG. 8 illustrates a further aspect of invention, namely the arrangement of antenna modules as disclosed with reference to FIG. 6. FIG. 8 illustrates antenna modules 81, 82 and 83 arranged in a side-by-side manner. Such an arrangement of antenna modules may be incorporated into a gaming table, such as a roulette or card table as illustrated in FIG. 9. In FIG. 9, there is a gaming table 91 having a playing surface 92, with legs 93, and within the gaming table 91, there is incorporated antenna module 81, 82, 83 and/or 8*n*, depending on what area is to be covered by an interrogating signal (such as a powering and/or communication signal). The antenna module may be as disclosed herein. The modules may be coupled to any suitable activation/interrogating devices and/or management systems as is known in the gaming industries. The modules may be incorporated in any suitable manner, for example as an integral part of the table 91, within a recess or pocket (not shown) in the table 91 placed on the underside (not shown) of the gaming table 91, or associated in any other manner as is known in the gaming industry art.

Figure 10:
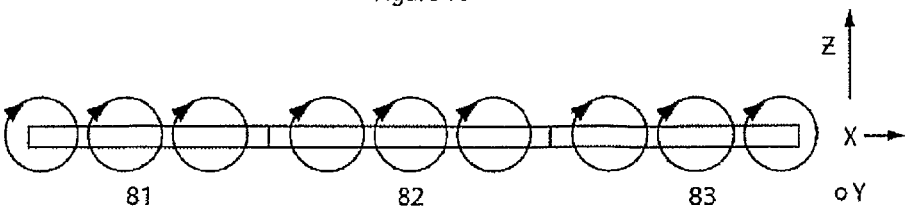
FIGS. 10 and 11 illustrate a magnetic field associated with the antenna module arrangement as illustrated in FIG. 8.
Figure 11:
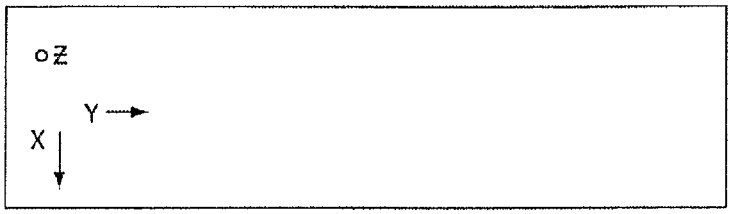

FIGS. 10 and 11 illustrate a magnetic field associated with the antenna module arrangement as illustrated in FIG. 8. The magnetic field tends to have a relatively strong field in the X and Z directions, and a reduced or limited field in the Y direction. This field strength is suitable for identifying, powering and/or communication with RFID devices (such as transponders, tag or tokens) which are known to be placed relatively close to the antenna module; that is they are placed only a limited distance from the antenna module in the X and Z direction.

Figure 12:
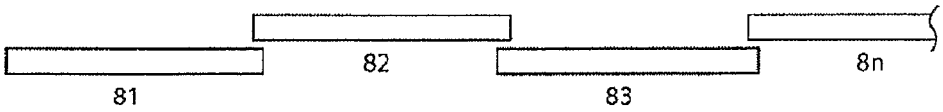
FIG. 12 illustrates an alternative arrangement of antenna modules in an overlapping relationship.

FIG. 12 illustrates an alternative arrangement of antenna modules 81, 82, 83 . . . 8*n*, in which they are placed in an overlapping relationship. That is, for example, the module 81 overlaps module 82, module 82 overlaps module 81 and 83, etc.

Figure 13:
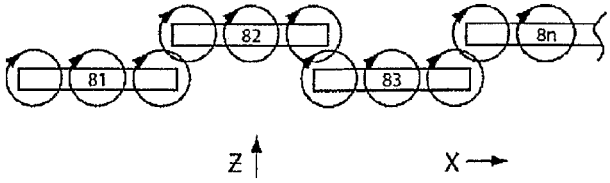
FIG. 13 illustrates a magnetic filed pattern associated with the antenna module arrangement of FIG. 12.

FIG. 13 illustrates a magnetic field pattern associated with the antenna module arrangement of FIG. 12. Firstly, it can be seen that the field strength is more consistent in a X and Z directions as compared to FIG. 10. Also, it can be seen that the filed strength extends further in the Z direction. These two features come about due to the overlapping nature of the antenna module arrangement as illustrated in FIG. 13.

Figure 14:
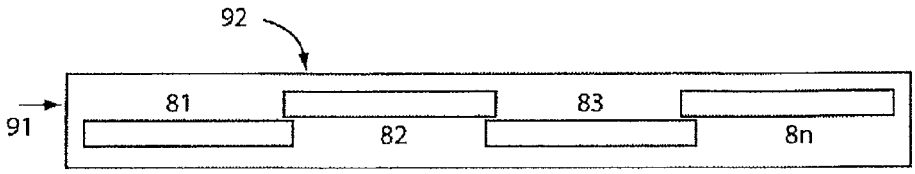
FIG. 14 shows the module arrangement of FIG. 12.

FIG. 14 shows the module arrangement of FIG. 12 as applied to a gaming table. The gaming table 91 has a playing surface 92, and within the table 91 are modules 81, 82, 83, 8*n* arranged in an overlapping relationship, that is a portion of the modules overlap an adjacent module. Preferably, the amount of overlapping is between 5 to 50% of the module direction of orientation and/or module area.

Figure 15:
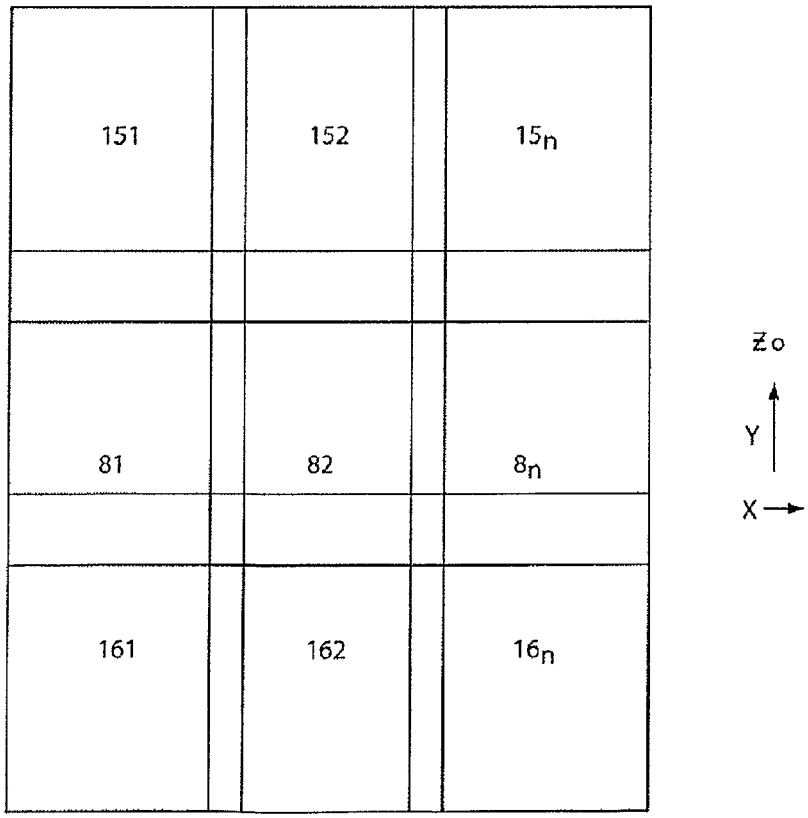
FIG. 15 shows an alternative module arrangement.

FIG. 15 illustrates an alternative module arrangement, in plan view, in which illustrates modules arranged in an overlapping relationship, namely modules 81, 82 . . . 8*n*, overlapped with each other, and modules 151, 152 . . . 15*n* overlapping with modules 81, 82 . . . 8*n*, and modules 161, 162 . . . 16*n* overlapping with modules 81, 82 . . . 8*n*. Such an arrangement may be used to cover a relatively small or large area, dependent on the number of modules used. Depending upon the orientation of the parallel conductors in each panel the magnetic field may be in the X, Y and Z directions. Such an arrangement may be used to cover a relatively small or large area, dependent on the number of modules used.

Figure 16:
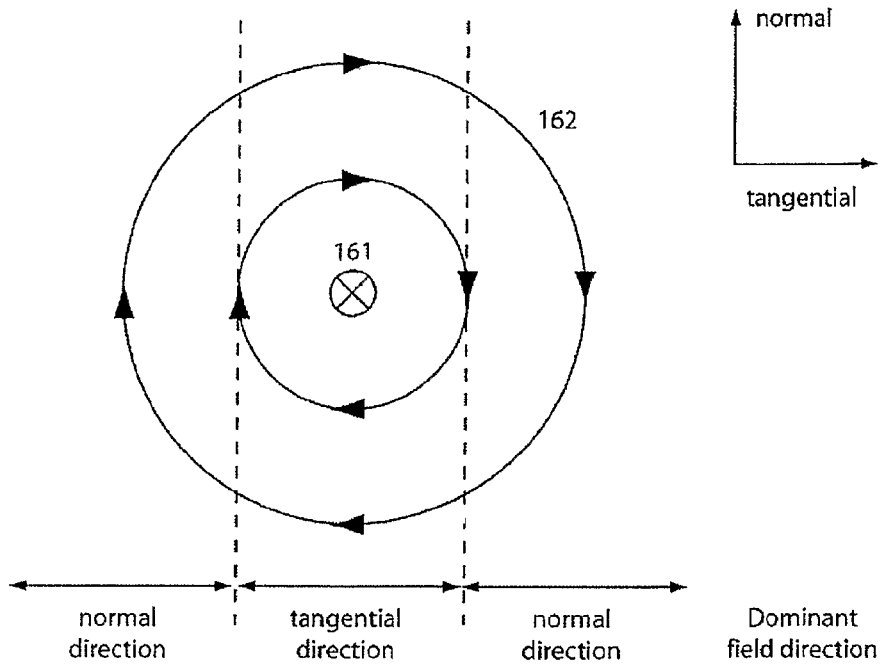
FIG. 16 shows in cross section a single current carrying conductor and illustrates the associated magnetic field and field directions.

FIG. 16 shows in cross section a single current carrying conductor 161 and illustrates the associated magnetic field 162 and field directions. To the left and right of the conductor the field direction is essentially vertical where as above and below the conductor the field direction is essentially horizontal. The vertical field direction has been labelled normal and the horizontal direction has been labelled tangential for reasons that will be explained shortly.

Figure 17:
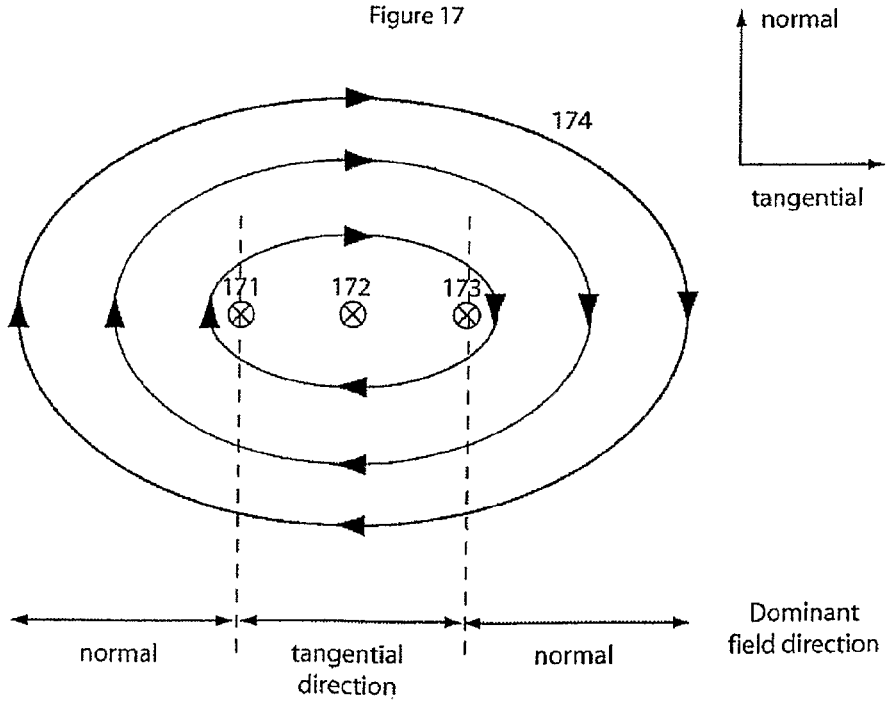
FIG. 17 shows in cross section multiple parallel current carrying conductors and illustrates the associated magnetic field and field directions, FIG. 18(*a*) shows a single turn coil, FIG. 18(*b*) shows the cross section r-r of the single turn coil shown in FIG. 18(*a*) and illustrates the associated magnetic field and field directions, FIG. 19(*a*) shows a three turn coil, FIG. 19(*b*) shows the cross section s-s of the three turn coil shown in FIG. 19(*a*) and illustrates the associated magnetic field and field directions.

FIG. 17 shows in cross section multiple parallel current carrying conductors 171,172,173 and illustrates the associated magnetic field 174 and field directions. The vertical and horizontally directed field regions are again labelled as normal and tangential respectively. The tangential field is oriented parallel to the plane of the conductors, that is; it is tangential to the plane of the conductors whereas the vertical field is normal to the plane of the conductors. The tangential and normal directions are defined with respect to the plane of the conductors in the rest of the text.

Figure 18A:
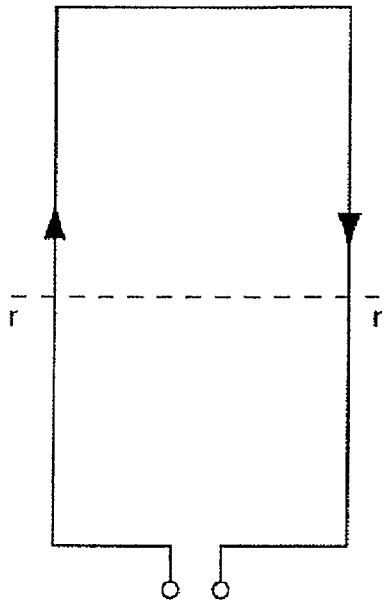
Figure 18B:
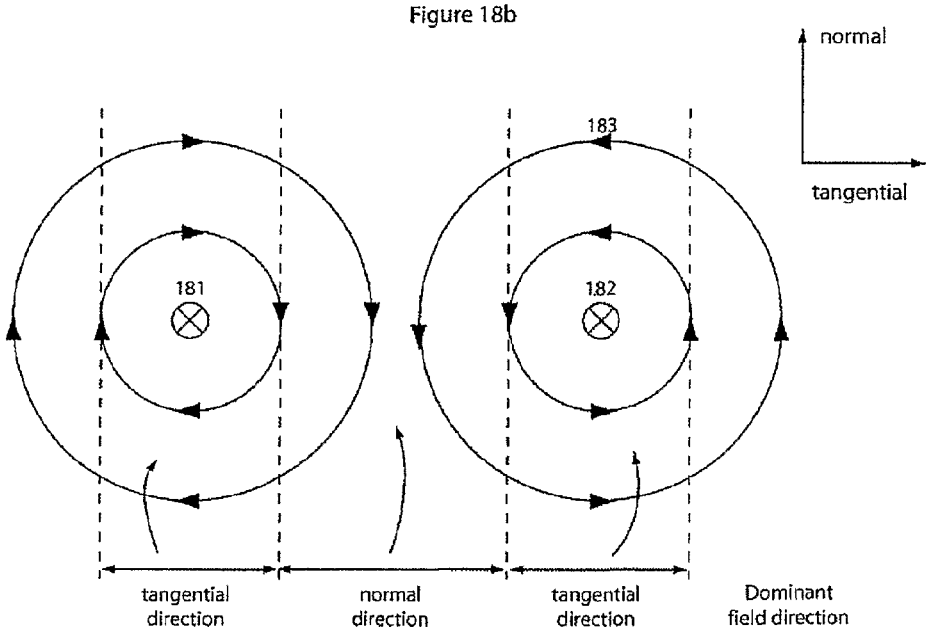

FIG. 18(*a*) shows a single turn coil and FIG. 18(*b*) shows the cross section r-r of the single turn coil shown in FIG. 18(*a*) illustrating the associated magnetic field and field directions. The current carrying conductors 181,182 of FIG. 18 are oppositely directed and illustrate the associated magnetic field 183 and field directions. The arrangement produces clearly defined region of normal and tangential fields.

Figure 19A:
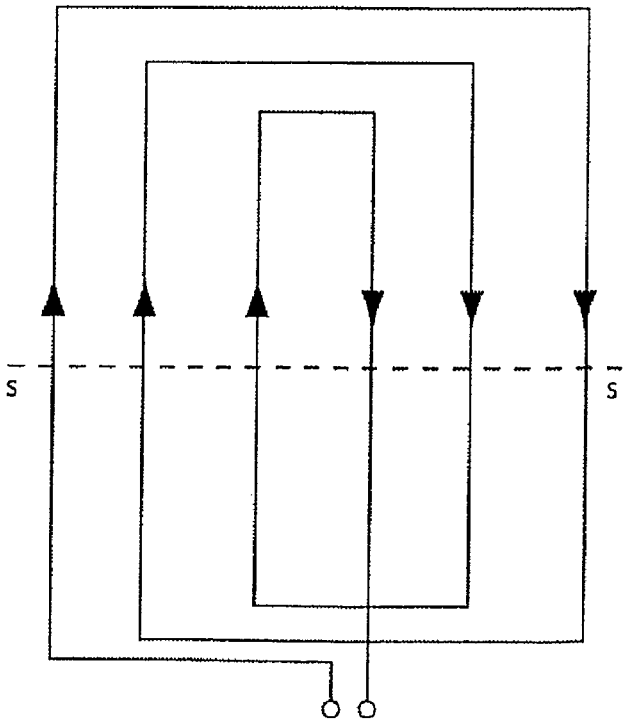
Figure 19B:
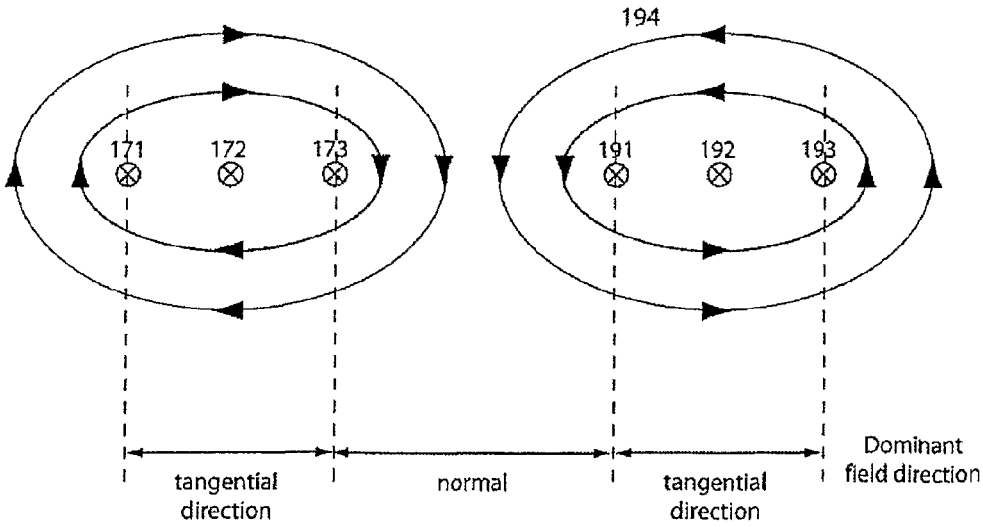

FIG. 19(*a*) shows a three turn coil and FIG. 19(*b*) shows the cross section s-s of the three turn coil shown in FIG. 19(*a*) illustrating the associated magnetic field and field directions. FIG. 19 shows in cross section a pair of a multiple parallel spaced current carrying conductors where the currents are oppositely directed and illustrate the associated magnetic field and field directions. Because of the parallel spacing of the conductors the tangential field is stretched to occupy an extended region over the conductors 171,172,173 and 191, 192,193. The normal field is substantially confined between the conductors 173 and 191. This arrangement provides for well directed tangential and normal fields which occupy a substantial volume around the conductors.

Figure 20:
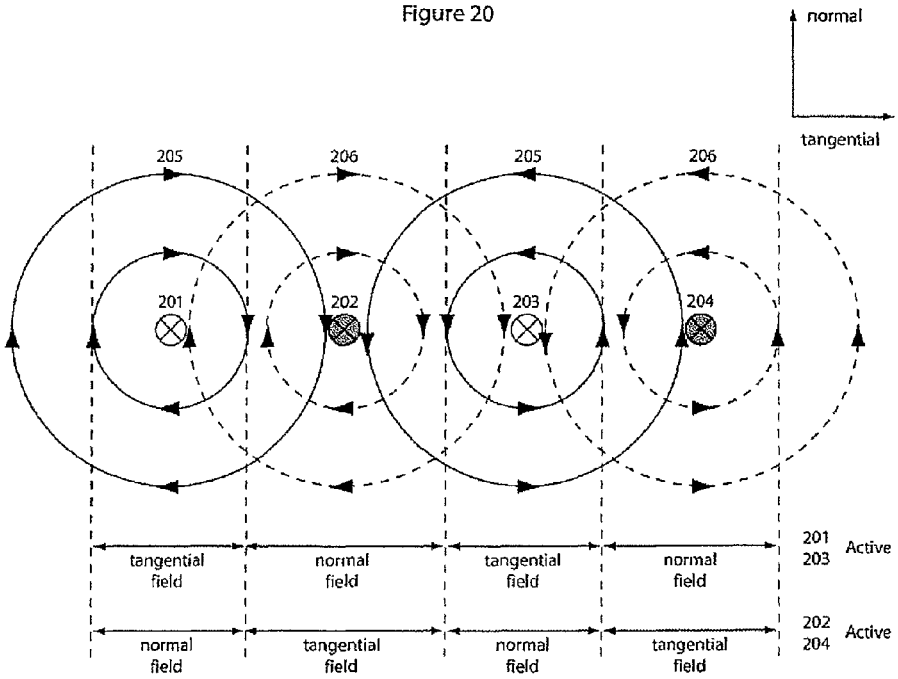
FIG. 20 shows the cross section p-p of the coil set shown in FIG. 26 and illustrates the associated magnetic field and field directions of this arrangement when switched alternatively, FIG. 21(*a*) shows a pair of three turn coils that are overlapped so that their groups of conductors are interleaved, FIG. 21(*b*) shows the cross section t-t of the coils shown in FIG. 21(*a*) and illustrates the associated magnetic field and field directions of this arrangement when switched alternatively.
Figure 26:
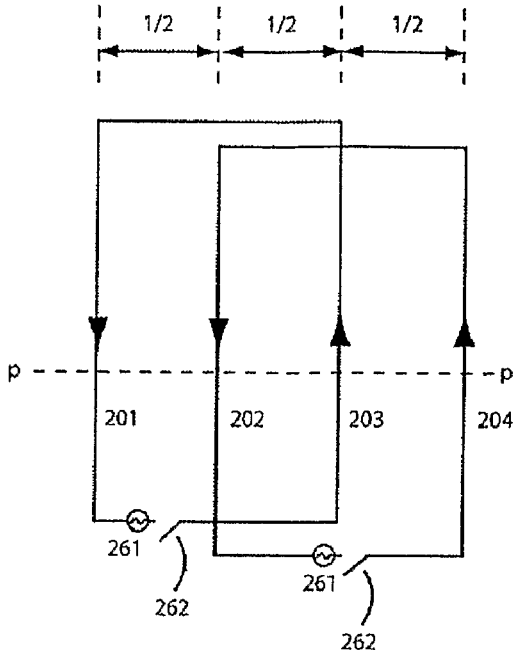
FIG. 26 shows in plan view a pair of coils using one signal source per coil, where the coils are individually and sequentially switched.

FIG. 20 shows the cross section p-p of the coil set shown in FIG. 26 and illustrates the associated magnetic field and field directions of this arrangement when switched alternatively. Conductors 201 and 203 are paired and conductors 202 and 204 are paired. The current is sequentially switched between the pair 201,203 and the pair 202,204. Current in conductor pair 201,203 produces magnetic field 205. Current in conductor pair 202,204 produces magnetic field 206. At different times a tangential and a normal magnetic field are produced at the same location above (or below) the plane of the conductors. A transponder orientated in the normal or tangential directions, or in any orientation between, will couple to at least one of the magnetic fields during the sequence of switching.

Figure 21B:
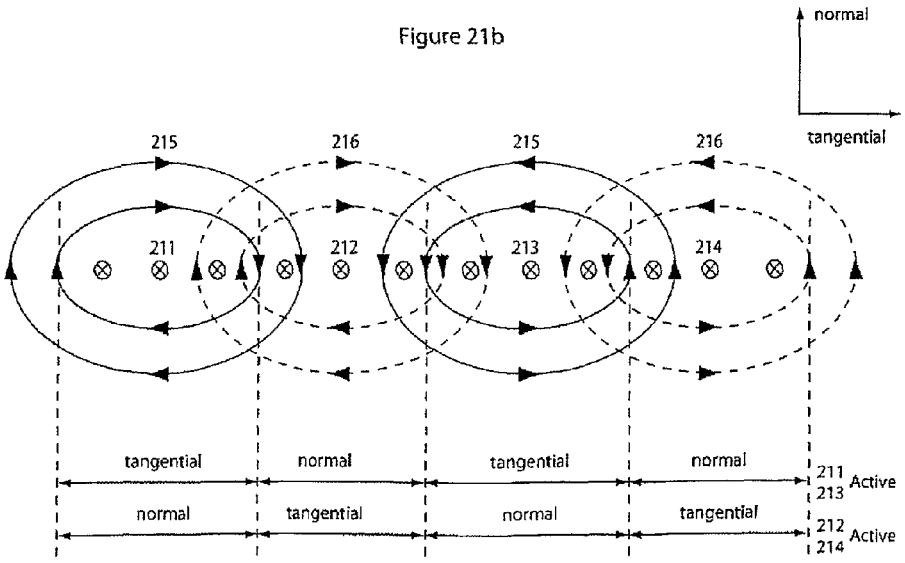
Figure 21A:
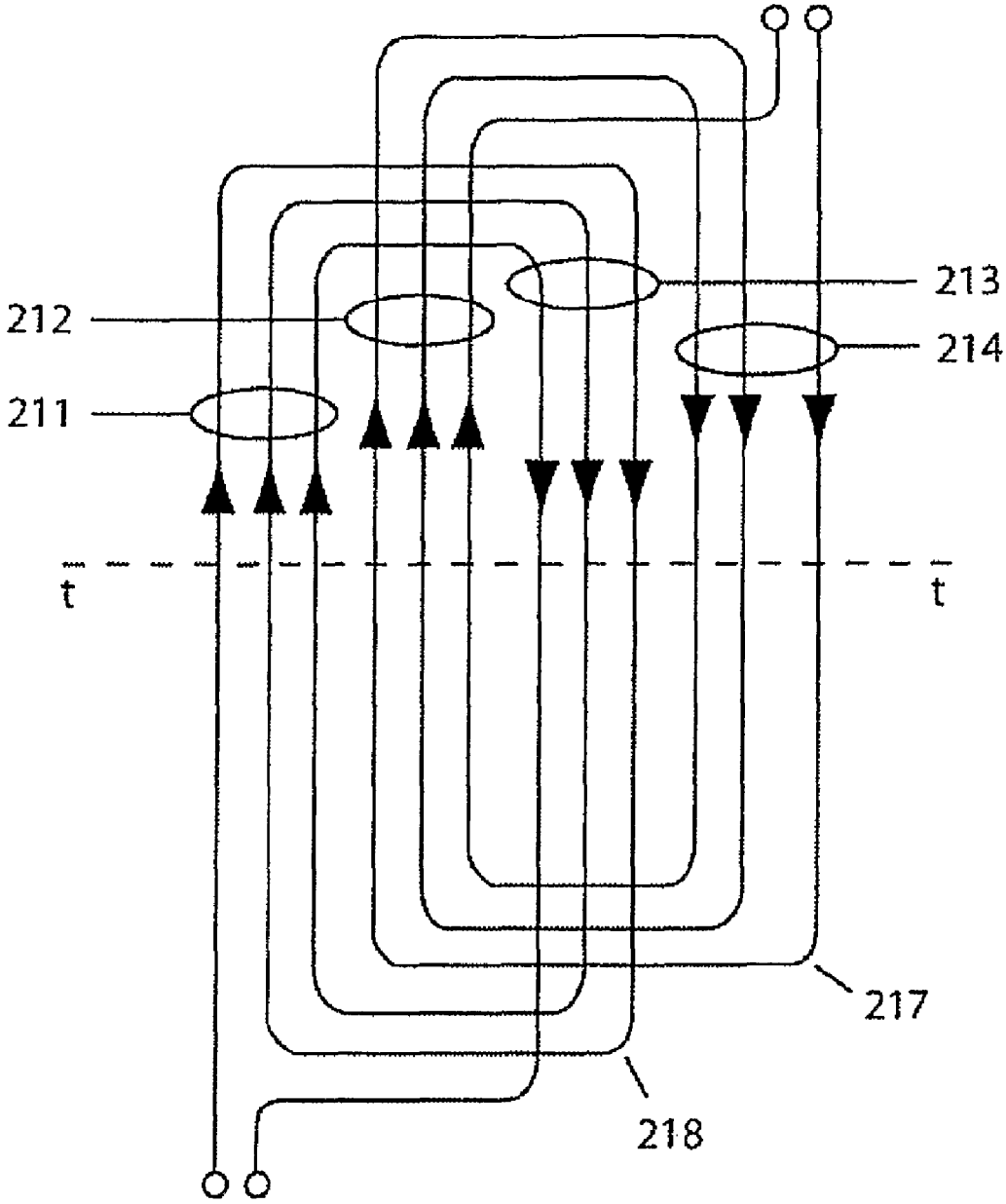

FIG. 21(*a*) shows a pair of three turn coils 217 and 218 that are overlapped so that their groups of conductors 211, 212, 213 and 214 are interleaved. FIG. 21(*b*) shows the cross section t-t of the coils shown in FIG. 21(*a*) and illustrates the associated magnetic fields 215 and 216 and field directions of this arrangement when switched alternatively. Conductor groups 211 and 213 are paired and likewise conductor groups 212 and 214 are paired. The current is sequentially switched between the pair 211,213 and the pair 212,214. Current in conductor pair 211,213 produces magnetic field 215. Current in conductor pair 212,214 produces magnetic field 216. At different times a tangential and a normal magnetic field are produced at the same location above (or below) the plane of the conductors. A transponder orientated in the normal or tangential directions, or any where in between, will couple to at least one of the magnetic fields during the sequence of switching.

Because of the parallel spacing of the conductors, the tangential field is 'stretched' to occupy an extended region from the conductors 211 to 214. The normal field is substantially confined between the conductors 211 and 213 when they are active or 212 and 214 when they are active. This simple arrangement of switched conductors provides for well directed tangential and normal fields between conductors 211 and 214, that extends over the length and width of the coil sets.

The sequential switching of coils is not limited to two sets of coils and can be extended without limit to a larger number of coils.

Figure 22:
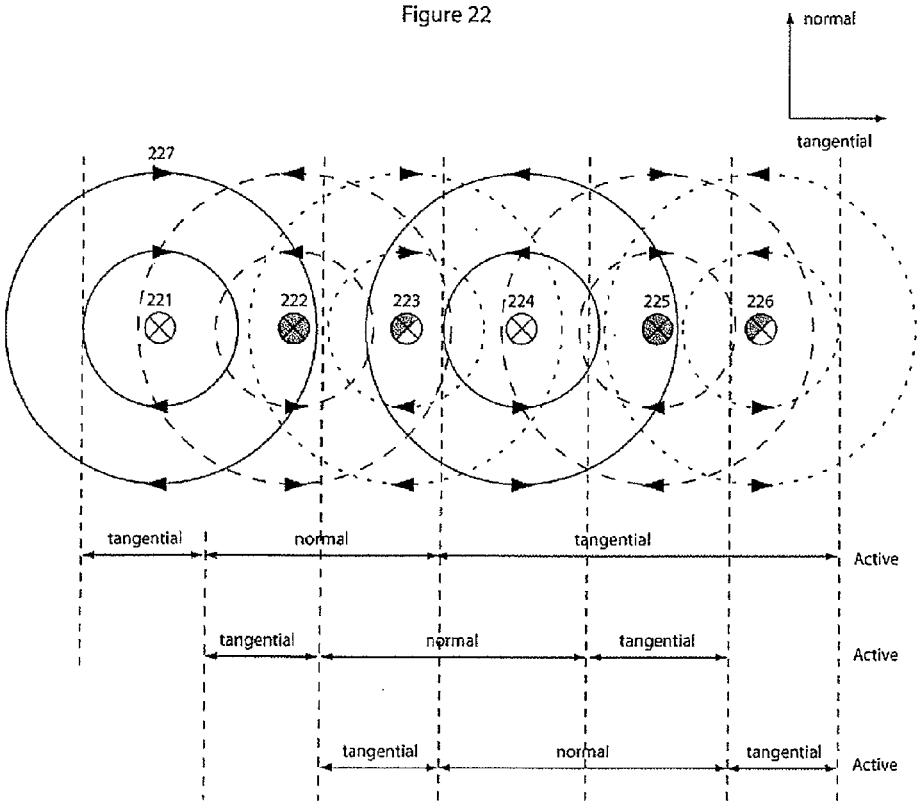
FIG. 22 shows in cross section m-m the coils shown in FIG. 24 and illustrates the magnetic fields and field directions associated with this arrangement when switched sequentially.
Figure 24:
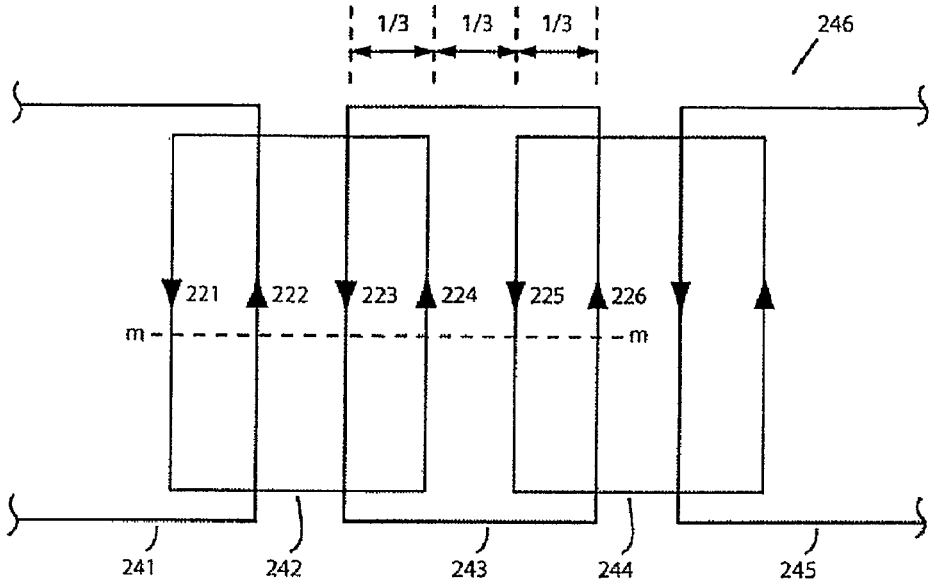
FIG. 24 shows in plan view an array overlapping sets of coils.

FIG. 22 shows the cross section m-m the coils 241, 242, 243 and 244 shown in FIG. 24 and illustrates the magnetic fields 227 and field directions associated with this arrangement when switched sequentially FIG. 22 shows in cross section three sets of conductors that are interleaved and illustrate the magnetic fields and field directions associated with this arrangement when switched sequentially. The arrangement shown in FIG. 22 can be extended indefinitely to any number of coils. It is also not limited to a single conductor per coil. Each single conductor can be replaced by multiple conductors. Multiple conductors have the advantages of producing a stronger field and receiving a stronger transponder reply signal when the conductors are connected in series (as for a multi-turn coil). Multiple conductors also have the advantage extending the tangential field uniformly over the length of the conductor group.

Figure 23:
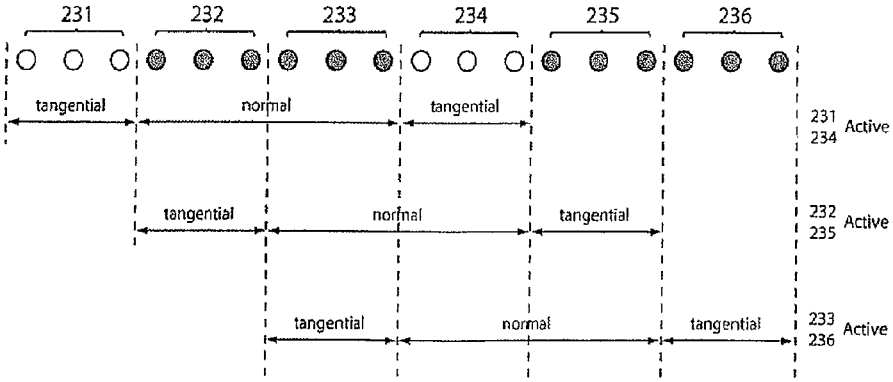
FIG. 23 shows in cross section where multiple conductors replace the individual conductors shown in FIG. 22 and illustrate the magnetic field directions associated with this arrangement when switched sequentially.
Figure 25:
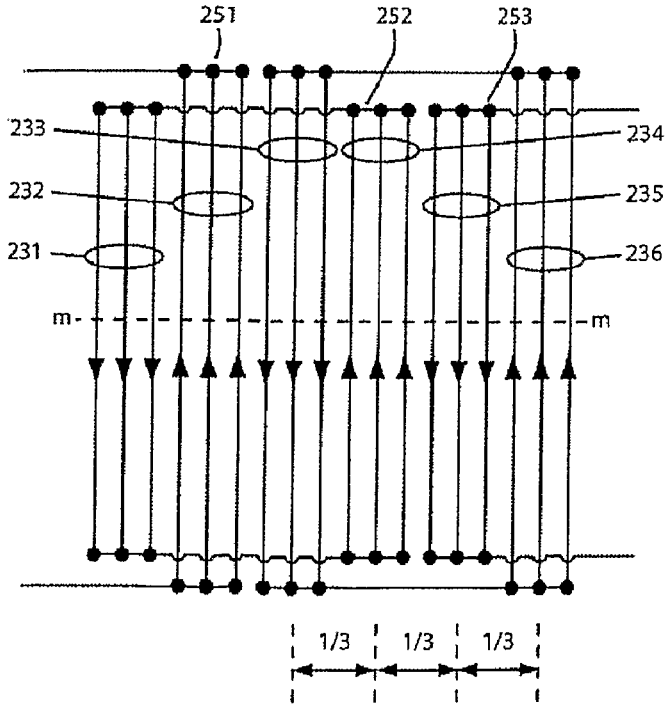
FIG. 25 shows a part of FIG. 24 where multiple conductors are used for each coil.

FIG. 23 shows the cross section m-m of the coil array shown in FIG. 25 where multiple conductors replace the individual conductors shown in FIG. 22 and illustrates the magnetic field directions associated with this arrangement when switched sequentially. For clarity the magnetic field lines are not included however their directions are clearly indicated and can be inferred directly from FIG. 21(*b*). Conductor groups 231, 234 and 232, 235 and 233,236 are paired and current is sequentially switched through them. Associated with each active group are regions of normal and tangential field. These regions are stepped down the length of the coil array and at some time a tangential and a normal magnetic field are produced at every location above (or below) the plane of the conductors. A transponder located any where above (or below) the array and orientated in the normal or tangential directions, or any where in between, will couple to at least one of the magnetic fields during the sequence of switching.

FIG. 24 shows in plan view an array overlapping sets of coils 241, 242, 243, 244 and 245. This array structure 246 can be extended indefinitely in both directions to the left and right and is an exemplary method of constructing an extended or extensive array for two dimensional reading.

The ideal spacing of the conductors is substantially ⅓ of the size each coil. That is ⅓, ⅓ and ⅓ as shown. Overall the conductors should preferably be spaced substantially uniformly across the antenna array however the spacing can vary 50% for a single conductor coil.

FIG. 25 shows a part of FIG. 24 where multiple conductors 231, 232, 233, 234, 235, and 236 are used for each coil 251, 252 and 253. Multiple conductors have the advantages of producing a stronger field and receiving a stronger transponder reply signal when the conductors are connected in series (as for a multi-turn coil). Multiple conductors also have the advantage extending the tangential field uniformly over the length of the conductor group. The ideal spacing of the conductors is substantially ⅓ of the size each coil. That is ⅓, ⅓ and ⅓ as shown. Overall the conductors should preferably be spaced substantially uniformly across the antenna array however the spacing can vary 150% for conductors in a multi turn coils or groups of conductors.

FIG. 26 shows in plan view a pair of coils using one signal source 261 per coil, where the coils are individually and sequentially switched. The preferred spacing between conductors is substantially ½ of the size of a coil as shown. Though this is the preferred spacing it can be varied by up to 50% for single conductor coils and 100% for multi turn coils. Between two coils in close proximity there may be significant mutual inductance. Through this mutual inductance the active coil will induce a voltage in the inactive coil. This voltage can be many hundreds of volts and will cause significant 'parasitic' currents to flow in the inactive coil. This is very undesirable because it distorts the magnetic field in an unpredictable fashion potentially causing transponder failures and applies an additional load to the active coil's circuits. By placing at least one switch 262 in series with each coil (more switches can be used) where the switch is open circuited when the coil is not active these 'parasitic' currents can be reduced or eliminated. Additional switches are particularly advantageous where a coil has high stray capacitance which can allow 'parasitic' currents to bypass a switch.

While a simple mechanical switch is shown this is just indicative of the function performed and not the implementation. Any suitable switching arrangement may be used without departing from the scope of the present invention. There are many mechanical, electrical and electronic methods of realising the switching function. That is sequencing the coil currents and/or preventing (or reducing) 'parasitic' currents in the inactive coils. Also the switching of the signal currents and the prevention of 'parasitic' currents may be done by separate and distinctly different methods.

For example the sequencing of the coil currents can be done by turning the signal sources ON or OFF whereas the antenna switch can be realised by other methods explained below. Examples of antenna switches are mechanical such as mechanical switches, relay switches. There are electrical switches such as reed relay switches and mercury wetted relay switched. Reed relay and mercury wetted reed relay switches have the advantage of high, speed operation, long lifetime and ideal switch current/voltage characteristics. There are also electronic switches such as diode switches, MOSFET switches and PIN diode switches. These switches have the advantage of very high speed operation and essentially unlimited lifetime. Their main disadvantage is that their current/voltage characteristics is sensitive to the coil voltage.

There are other methods of reducing mutual inductance such as cancelling transformers for example as shown in FIG. 26B of U.S. Pat. No. 5,258,766 or by positioning coils so that the magnetic linkage is zero.

Figure 27:
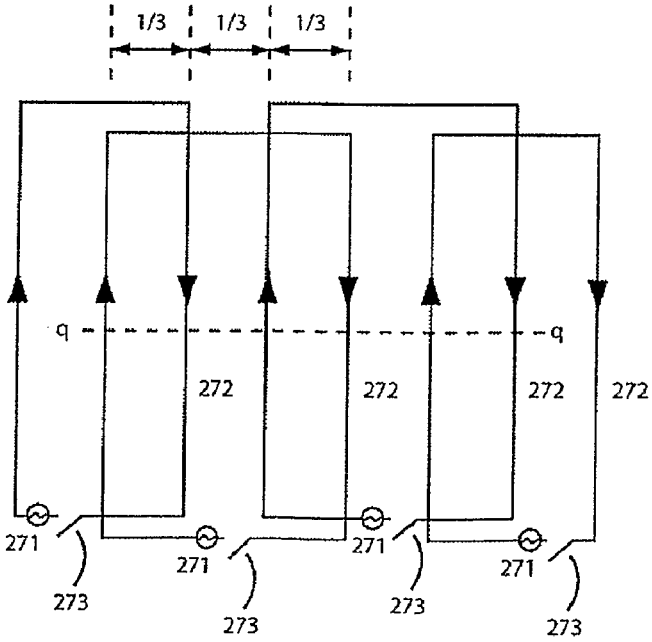
FIG. 27 shows in plan view part of an array of coils using one signal source per coil, where the coils are individually and sequentially switched, FIGS. 28(*a*) and 28(*b*) show two embodiments of an arrangement of parallel conductors using one signal source that can be selectively and sequentially configured to function as the arrangement shown in FIG. 26.

FIG. 27 shows in plan view part of an array of coils using one signal source 271 per coil 272, where the coils are individually and sequentially switched. This array can be extended to the left and right by copying the form shown in FIG. 24. FIG. 27 clearly shows that an array of antennas can be powered from individual sources and that at least one (or more) series switches 273 can be included to both switch the coil currents and prevent 'parasitic' from flowing in the inactive coils. The preferable spacing of conductors is substantially equal which leads to the preferable spacing of substantially 1;3 of a coil size between conductors.

Figure 28A:
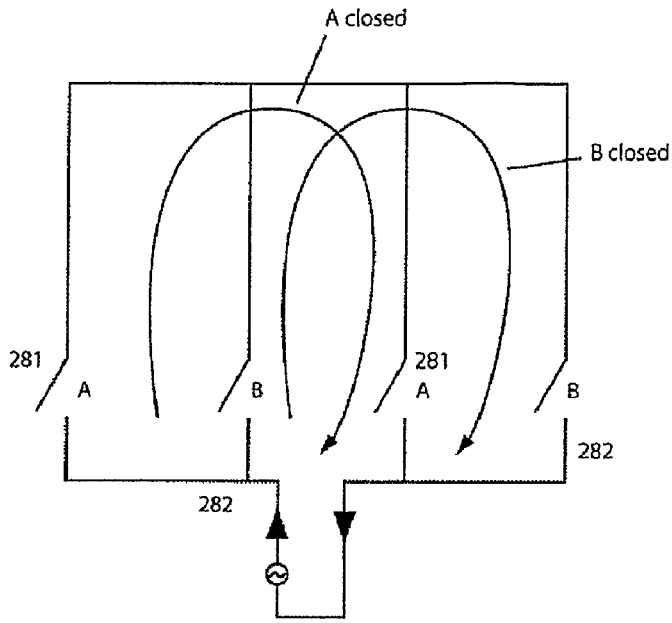
Figure 28B:
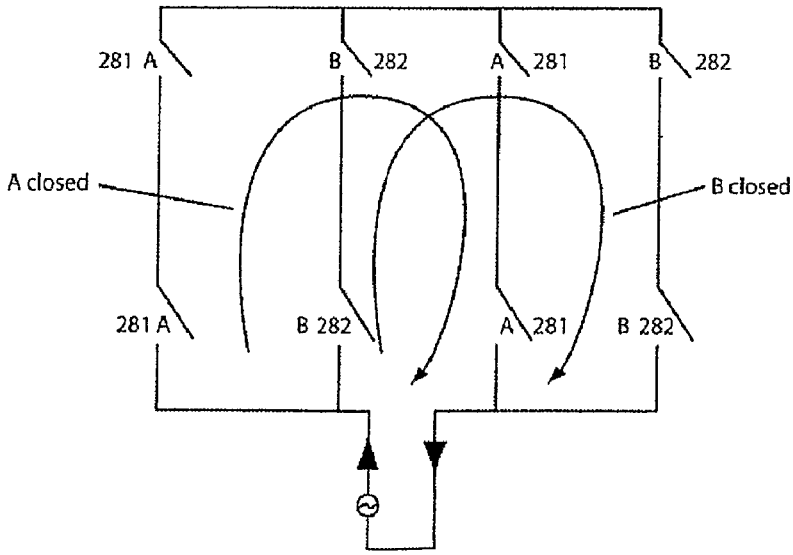

While the discussion above has described one signal source per coil it is advantages to use only one signal source for more than one coil. This is advantageous because of the cost saving in only having one signal source. FIGS. 28(*a*) and 28(*b*) show two embodiments of an arrangement of parallel conductors using one signal source that can be selectively and sequentially configured to function as the arrangement shown in FIG. 26. The switches 'A' 281 and 'B' 282 are sequentially operated so that only one coil is active while the other coil is 'open circuited' by its switch(s) to prevent 'parasitic' currents.

Figure 29:
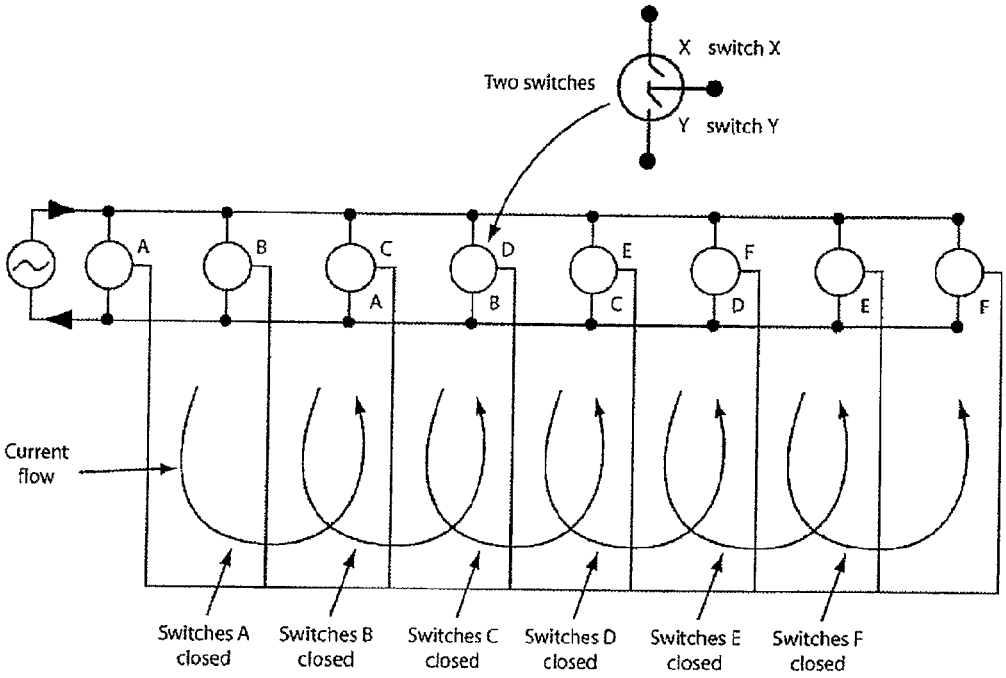
FIG. 29 shows an embodiment of an arrangement of parallel conductors using one signal source that can be selectively and sequentially configured to function as an array of coils equivalent to the arrangements shown in FIGS. 24, 25 and 27.

This method can be extended to any array of antenna coils such as shown in FIGS. 24, 25, and 27. FIG. 29 shows an embodiment of an arrangement of parallel conductors using one signal source that can be selectively and sequentially configured to function as an array of coils equivalent to the arrangements shown in FIGS. 24, 25 and 27. Only one coil is active at any time while the inactive coils are 'open circuited' to prevent 'parasitic' currents. Associated with each active coil are regions of normal and tangential field. These regions are stepped down the length of the coil array and at some time a tangential and a normal magnetic field are produced at every location above (or below) the plane of the conductors. A transponder located anywhere above (or below) the array and orientated in the normal or tangential directions, or any where in between, will couple to at least one of the magnetic fields during the sequence of switching.

Figure 30:
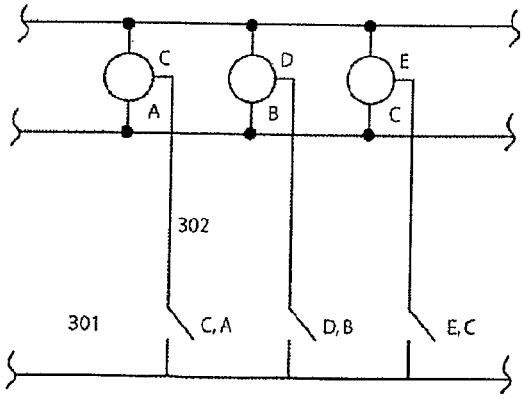
FIG. 30 shows an alternative switching arrangement for the circuit shown in FIG. 29.

FIG. 30 shows an alternative switching arrangement for the circuit shown in FIG. 29 where an additional switch 301 has been included in each conductor 302. While only one switch is shown the number of switches is not limited and can be extended to more as required. More switches are advantageous where a coil has high stray capacitance which can allow 'parasitic' currents to bypass a switch. The alternative switching arrangement for the circuit shown in FIG. 29 that is particularly suited to multiple turn coils.

Figure 31:
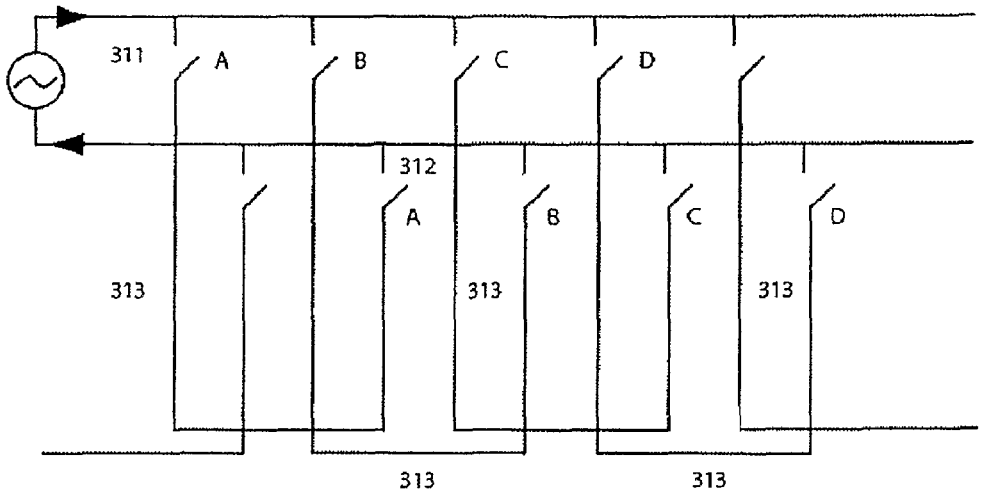
FIG. 31 shows an alternative switching arrangement for the circuit shown in FIG. 29 that is particularly suited to multiple turn coils.

FIG. 31 shows an alternative switching arrangement for the circuit shown in FIG. 29 that is particularly suited to multiple turn coils 321. Each coil 313 has a switch 311 and 312 at both ends of the coil where it connects to the signal source. In this way each coil 313 can be uniquely connected to the one signal source.

Figure 32:
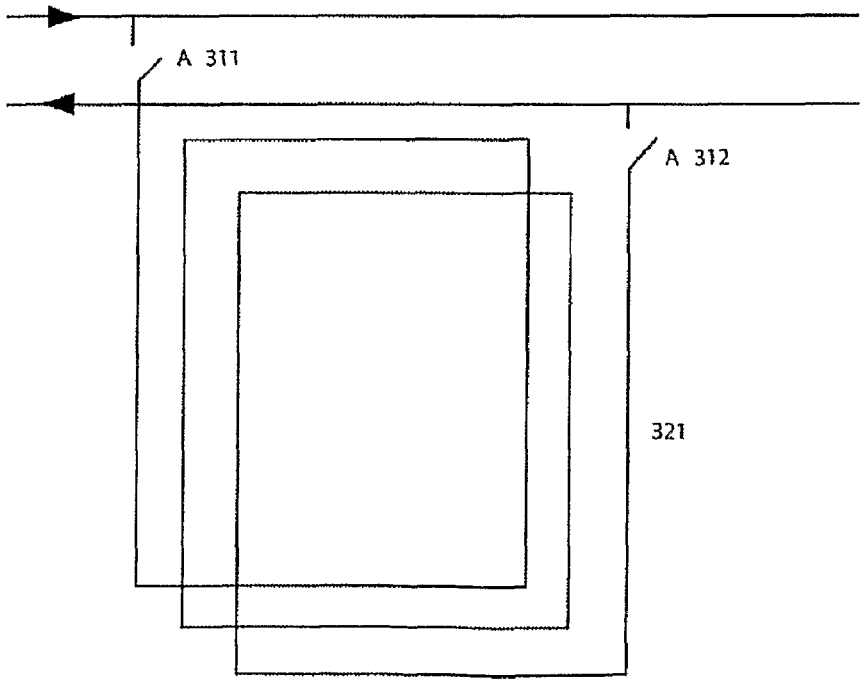
FIG. 32 shows how a multiple turn coil can be used in the switching arrangement shown in FIG. 31, FIGS. 33(*a*), 33(*b*) and 33(*c*) illustrates how two panels of parallel sequentially switched conductors when placed parallel to each other with the conductors orthogonally orientated will produce a three dimensional field.

FIG. 32 shows how a multiple turn coil 321 can be used in the switching arrangement shown in FIG. 31. In this way a multi turn coil 321 can be uniquely connected to the one signal source. Multiple turn coils have the advantages of producing a stronger field and receiving a stronger transponder reply signal as the conductors are connected in series. They also have the advantage of extending the tangential field uniformly over the length of the coil conductor group. While only one multi turn coil is shown it is only indicative and the array of multi turn coils can be extended indefinitely as shown in FIG. 31.

Figure 33A:
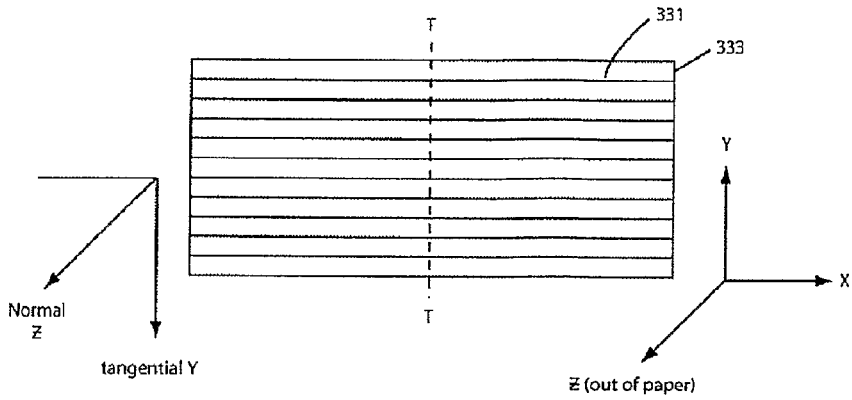
Figure 33B:
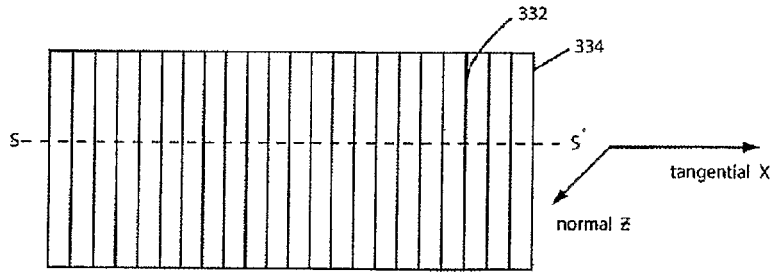
Figure 33C:
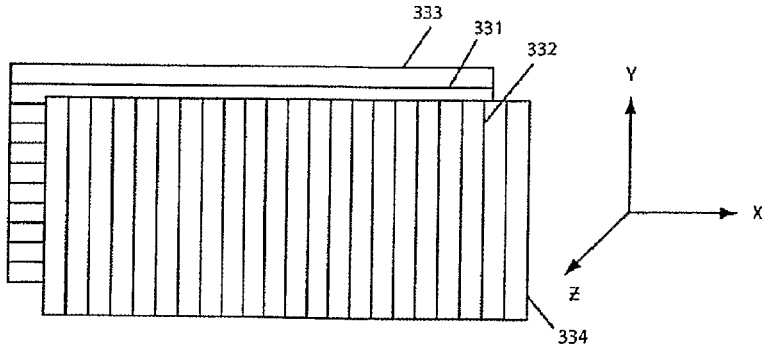

FIGS. 33(*a*), 33(*b*) and 33(*c*) illustrate how two panels of parallel sequentially switched conductors when placed parallel to each other with the conductors orthogonally orientated will produce a three dimensional field. These panels are constructed in accordance with the principles for constructing or operating sequentially switched parallel conductor explained above. For the Figures shown the X, Y and Z directions are; X horizontal left to right on the page, Y vertical up and down on the page, and Z in the third dimension coming directly out of the page surface.

The antenna panel 333 shown in FIG. 33(*a*) has parallel conductors 331 arranged in a horizontal direction and produced a field in the Y direction and in the Z direction. The conductors are suitably interconnected, but the connections are not shown as any suitable manner of coupling to a source of power and/or communications can be implemented.

The antenna panel 334 shown in FIG. 33(*b*) has parallel conductors 332 arranged in a vertical direction and produced a field in the X direction and in the Z direction. The conductors are suitably interconnected, but the connections are not shown as any suitable manner of coupling to a source of power and/or communications can be implemented.

Due to their planar construction the panels 333 and 334 can be placed in relatively close proximity to each other, such as even onto of each other as shown in FIG. 33(*c*). The panels are shown offset for clarity however this is not required for operation and the panels can be stacked directly on top of each other. The conductors in this composite panel are now sequentially switched such that only one coil or conductor set is active at a time. The composite panel will produce a field in the X, Y and Z directions as it is sequentially switched. The composite panel can be operated from one signal source where the conductors are switched according to the methods disclosed above in FIGS. 28(*a*), 28(*b*), 29, 30, 31 and 32.

Figure 34:
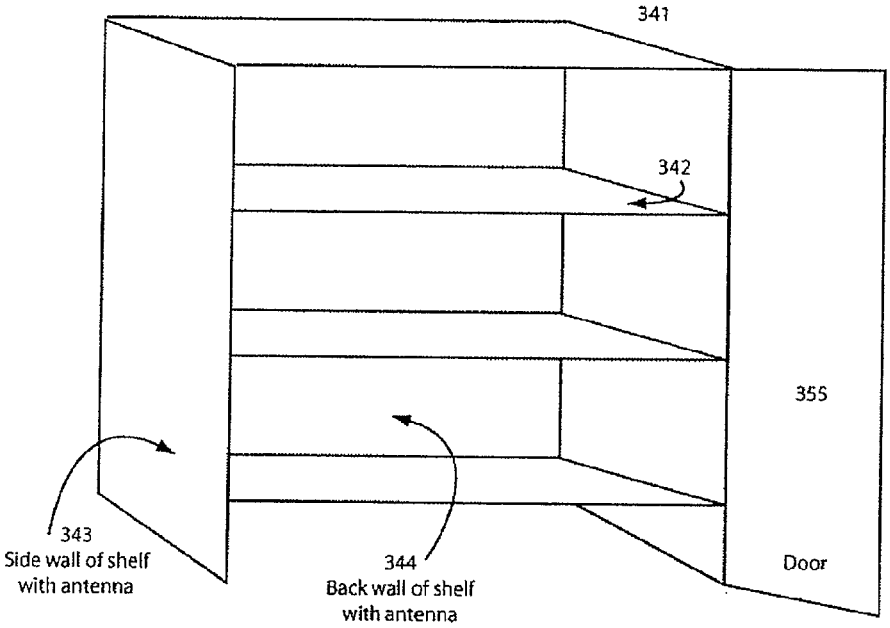
FIG. 34 shows an application for the invention.

FIG. 34 shows an application for the invention where the invention is included in a shelving system 341. The invention can be included in the shelves 342 and/or the side walls 343 and/or the back wall 344 and/or front door 365 of the shelving cabinet. The invention can provide two or three dimensional reading depending upon the placement of and direction of the conductors use.

Figure 35:
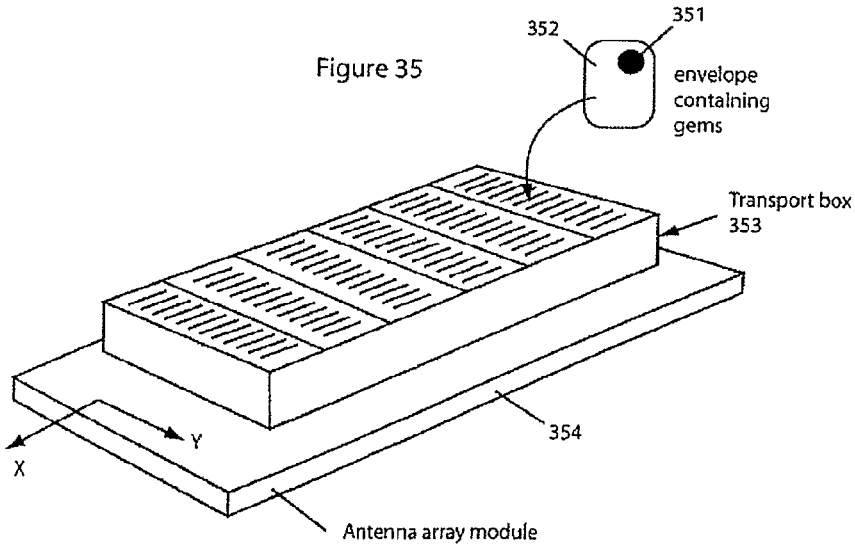
FIG. 35 shows another application for the invention.

FIG. 35 shows another application for the invention where the invention is used to read closely stacked gem or jewelry transponders 351. Each gem or jewel is placed in a small envelope 352 that is place closely stacked in a transport and storage box 353. A transponder 351 is also placed in each envelope and identifies the gem or jewel. The transponder may also be programmed with information about the gem/jewel and/or be programmed with transport information. The contents of the box can be quickly read for stock take or security purposes by placing in on a panel 354 made according to either or any of FIGS. 33(*a*), 33(*b*) or 33(*c*).

Figure 36:
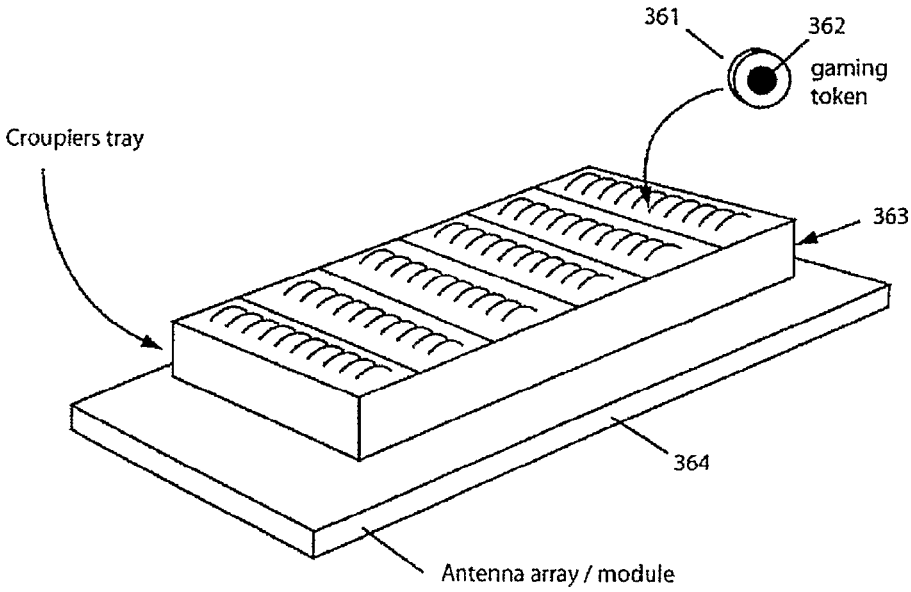
FIG. 36 shows still a further application for the invention.

FIG. 36 shows still a further application for the invention where the invention is used to read closely stacked gaming tokens 361 which include an embedded transponder 362. Each token is placed closely stacked in a croupier's tray 363 for gaming, transport and storage. The transponder 362 identifies the token and may also be programmed with information about the token and/or owner of the token and/or transport information. The contents of the croupiers box 363 can be quickly read for operational, stock take or security purposes by placing in on a panel 364 made according to either or any of FIGS. 33(*a*), 33(*b*) or 33(*c*).

Figure 37:
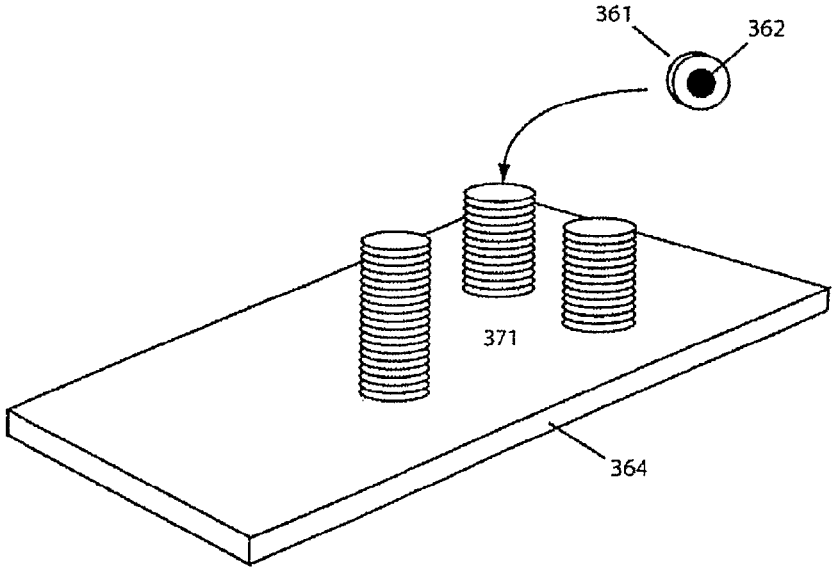
FIG. 37 shows still a further application for the invention where the Invention is used to read closely stacked gaming tokens 361 which include an embedded transponder 362.

FIG. 37 shows still a further application for the invention where the invention is used to read closely stacked gaming tokens 361 which include an embedded transponder 362. Each token is placed closely stacked in a vertical column 371 on table or tray 363 for gaming, transport or storage. The transponder 362 identifies the token and may also be programmed with information about the token and/or owner of the token and/or transport information. All of the tokens placed on the antenna 364 can be quickly read for operational, stock take or security purposes. The panel 364 may be made according to either or any of FIGS. 33(*a*), 33(*b*) or 33(*c*). This is a particularly advantageous interrogator antenna for roulette tables and mass storage systems for gaming tokens.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

"Comprises/comprising" when used in this specification is taken to specify the presence of stated features, integers, steps or components but does not preclude the presence or addition of one or more other features, integers, steps, components or groups thereof." Thus, unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

The claims defining the invention are as follows:

1. An arrangement of coils, comprising:

a first coil having at least two first windings;

a second coil having at least a second winding;

the second winding being juxtaposed intermediate the at least two first windings;

wherein the first coil comprises 2, 3 or more than 3 windings; and wherein at least one of the first coil and the second coil comprises a first layer of parallel spaced conductors and a second parallel layer of orthogonally oriented parallel spaced conductors for three dimensional operations.

2. An arrangement of coils, comprising:

a first coil having at least two first windings;

a second coil having at least a second winding;

the second winding being juxtaposed intermediate the at least two first windings;

switching means adapted to switch currents sequentially through the first winding and then at least the second winding; and wherein a spatial relationship of sequentially switched currents is chosen to ensure that at different times tangential and normal magnetic fields are produced at substantially a same location.

3. The arrangement as claimed in claim 1, wherein the first and second windings are disposed in substantially a same plane.

4. The arrangement as claimed in claim 1, wherein the first windings are disposed in a plane offset from a plane of the second winding.

5. The arrangement as claimed in claim 1, wherein the first coil comprises 3 windings.

6. The arrangement as claimed in claim 1, wherein the second coil comprises 2, 3 or more than 3 windings.

7. The arrangement as claimed in claim 1, wherein the first and/or second coil comprises a single layer of parallel spaced conductors for two dimensional operations.

8. The arrangement as claimed in claim 1, wherein currents are sequentially switched in the first and second layers.

9. The arrangement as claimed in claim 1, wherein the first and second coils are disposed in a module.

10. The arrangement as claimed in claim 1, wherein the first and second windings are a series of parallel spaced conductors which, in use are adapted to produce both tangential and normal magnetic field components.

11. The arrangement as claimed in claim 1, wherein at least a portion of the first and second coils are arranged in a planar fashion.

12. The arrangement as claimed in claim 1, wherein at least a portion of the first and second coils are arranged to produce tangential and normal magnetic fields above a planar surface.

13. An interrogator including an arrangement of coils comprising:

a first coil having at least two first windings;

a second coil having at least a second winding;

the second winding being juxtaposed intermediate the at least two first windings;

wherein the first coil comprises 2, 3 or more than 3 windings; and wherein at least one of the first coil and the second coil comprises a first layer of parallel spaced conductors and a second parallel layer of orthogonally oriented parallel spaced conductors for three dimensional operations.

14. The interrogator as claimed in claim 13, further comprising a plurality of modules, at least one of the plurality of modules being arranged in an overlapping relationship with an adjacent module.

15. The interrogator as claimed in claim 14, wherein the overlapping enhances interrogation of a device in an X direction.

16. The interrogator as claimed in claim 14, wherein the overlapping enhances interrogation of a device in a Y direction.

17. The interrogator as claimed in claim 14, wherein the overlapping enhances interrogation of a device in a Z direction.

18. The interrogator as claimed in claim 13, wherein the interrogator is an RFID interrogator.

19. The interrogator as claimed in claim 13, the interrogator comprises at least one of a shelf reader, a roulette table reader, a gaming table reader, a croupiers tray reader, a document tray reader, a gem box reader, a medical cabinet reader.

20. The interrogator as claimed in claim 13, wherein the interrogator is adapted to operate in any one or any combination of X, Y and/or Z directions.

21. A method of energizing a first arrangement of coils and a second arrangement of coils, the first coils having at least two first windings and the second coil having at least a second windings, the second winding being juxtaposed intermediate the first windings, the method comprising the steps of:

energizing the first coil;

energizing the second coil;

providing at least one of a first coil and a second coil comprising a first layer of parallel spaced conductors and a second parallel layer of orthogonally oriented parallel spaced conductors for three dimensional operations; and wherein the first coil and the second coil are alternately switched.

22. The method as claimed in claim 21, wherein the first winding and then the second winding are sequentially energized.

23. The method as claimed in claim 21, wherein when the first coil is energized, the second coil is open circuited.

24. The method as claimed in claim 21, wherein when the second coil is energized, the first coil is open circuited.

25. The method as claimed in claim 21, wherein the arrangement of coils is replicated and overlapped to create a larger arrangement of switched coils and/or where each coil is sequentially switched.

26. The method as claimed in claim 21, further comprising the step of providing a first and/or second coil comprising a single layer of parallel spaced conductors for two dimensional operations.

27. The method as claimed in claim 21, further comprising the step of arranging the first and second coils in a manner to enable fields to be produced in any one or any combination of X, Y and Z directions.

28. The method as claimed in claim 21, wherein the energizing is adapted to power a remote device.

29. The method as claimed in claim 21, wherein the energizing is adapted to communicate with a remote device.

30. The method as claimed in claim 29, wherein the remote device is a RFID device.

31. An interrogator adapted to energize an arrangement of coils, comprising:

processor means adapted to operate in accordance with a predetermined instruction set and being adapted to perform the method as claimed in claim 21.

32. A computer program product including;

a computer usable medium having computer readable program code and computer readable system code embodied on a medium for energizing at least two coils associated with interrogator apparatus in conjunction with commands from a data processing system, said computer program product including:

computer readable code within said computer usable medium for performing the method as claimed in claim 21.

33. The interrogator as claimed in claim 14, wherein at least one module of the plurality of modules overlaps the adjacent module greater than zero and less than 50% of a module dimension.

34. The interrogator as claimed in claim 14, wherein at least one module of the plurality of modules overlaps the adjacent module greater than zero and less than 80% of a module dimension.

35. The interrogator as claimed in claim 14, wherein at least two modules of the plurality of modules are arranged in an overlapping relationship.

36. The arrangement as claimed in claim 2, wherein the first and second windings are disposed in substantially a same plane.

37. The arrangement as claimed in claim 2, wherein the first windings are disposed in a plane offset from a plane of the second winding.

38. The arrangement as claimed in claim 2, wherein the first coil comprises 3 windings.

39. The arrangement as claimed in claim 2, wherein the first coil comprises 2, 3 or more than 3 windings.

40. The arrangement as claimed in claim 2, wherein the second coil comprises 2, 3 or more than 3 windings.

41. The arrangement as claimed in claim 2, wherein at least one of the first coil and the second coil comprises a single layer of parallel spaced conductors for two dimensional operations.

42. The arrangement as claimed in claim 2, wherein at least one of the first coil and the second coil comprises a first layer of parallel spaced conductors and a second parallel layer of orthogonally oriented parallel spaced conductors for three dimensional operations.

43. The arrangement as claimed in claim 42, wherein currents are sequentially switched in the first and second layers.

44. The arrangement as claimed in claim 2, wherein the first and second coils are disposed in a module.

45. The arrangement as claimed in claim 2, wherein the first and second windings are a series of parallel spaced conductors which, in use are adapted to produce both tangential and normal magnetic field components.

46. The arrangement as claimed in claim 2, wherein at least a portion of the first and second coils are arranged in a planar fashion.

47. The arrangement as claimed in claim 2, wherein at least a portion of the first and second coils are arranged to produce tangential and normal magnetic fields above a planar surface.

48. An interrogator including an arrangement of coils comprising:

a first coil having at least two first windings;

a second coil having at least a second winding;

the second winding being juxtaposed intermediate the at least two first windings;

switching means adapted to switch currents sequentially through the first winding and then at least the second winding; and wherein a spatial relationship of sequentially switched currents is chosen to ensure that at different times tangential and normal magnetic fields are produced at substantially a same location.

49. The interrogator as claimed in claim 48, further comprising a plurality of modules, at least one of the plurality of modules being arranged in an overlapping relationship with an adjacent module.

50. The interrogator as claimed in claim 49, wherein the overlapping enhances interrogation of a device in an X direction.

51. The interrogator as claimed in claim 49, wherein the overlapping enhances interrogation of a device in a Y direction.

52. The interrogator as claimed in claim 49, wherein the overlapping enhances interrogation of a device in a Z direction.

53. The interrogator as claimed in claim 48, wherein the interrogator is an RFID interrogator.

54. The interrogator as claimed in claim 48, the interrogator comprises at least one of a shelf reader, a roulette table reader, a gaming table reader, a croupiers tray reader, a document tray reader, a gem box reader, a medical cabinet reader.

55. The interrogator as claimed in claim 48, wherein the interrogator is adapted to operate in any one or any combination of X, Y and/or Z directions.

56. The interrogator as claimed in claim 49, wherein at least one module of the plurality of modules overlaps the adjacent module greater than zero and less than 50% of a module dimension.

57. The interrogator as claimed in claim 49, wherein at least one module of the plurality of modules overlaps the adjacent module greater than zero and less than 80% of a module dimension.

58. The interrogator as claimed in claim 49, wherein at least two modules of the plurality of modules are arranged in an overlapping relationship.

59. The arrangement as claimed in claim 1, further comprising:

switching means adapted to switch currents sequentially through the first winding and then at least the second winding.

60. The arrangement as claimed in claim 59, wherein a spatial relationship of sequentially switched currents is chosen to ensure that at different times tangential and normal magnetic fields are produced at substantially a same location.

* * * * *

UNITED STATES PATENT AND TRADEMARK OFFICE

CERTIFICATE OF CORRECTION

PATENT NO. : 7,928,847 B2
APPLICATION NO. : 12/066287
DATED : April 19, 2011
INVENTOR(S) : Graham Alexander Murdoch et al.

It is certified that error appears in the above-identified patent and that said Letters Patent is hereby corrected as shown below:

COLUMN 3, AFTER LINE 5

Insert -- The present invention provides, in another aspect of invention, and interrogator including the arrangement as herein disclosed. --

COLUMN 5, LINE 50

Replace "FIG. 5billustrates"
With -- FIG. 5b illustrates --

Signed and Sealed this
Third Day of January, 2012

David J. Kappos

David J. Kappos
*Director of the United States Patent and Trademark Office*